US010800984B1

(12) United States Patent
Sun

(10) Patent No.: US 10,800,984 B1
(45) Date of Patent: Oct. 13, 2020

(54) PROCESS FOR HYDROTREATING A HYDROCARBON RESIDUE STREAM

(71) Applicant: UOP LLC, Des Plaines, IL (US)

(72) Inventor: Ping Sun, Hinsdale, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/558,067

(22) Filed: Aug. 31, 2019

(51) Int. Cl.
*C10G 67/14* (2006.01)
*C10G 69/04* (2006.01)

(52) U.S. Cl.
CPC ..... *C10G 67/14* (2013.01); *C10G 69/04* (2013.01); *C10G 2300/1077* (2013.01); *C10G 2300/202* (2013.01); *C10G 2300/205* (2013.01); *C10G 2300/207* (2013.01)

(58) Field of Classification Search
CPC ..... C10G 67/14; C10G 69/04; C10G 2300/1077; C10G 2300/202; C10G 2300/205; C10G 2300/207
See application file for complete search history.

(56) References Cited

U.S. PATENT DOCUMENTS 10,253,272 B2 4/2019 Sun
2013/0043159 A1* 2/2013 Hoehn ..... C10G 7/00 208/95
2018/0346829 A1* 12/2018 Sun ..... C10G 67/00

* cited by examiner

*Primary Examiner* — Brian A McCaig
(74) *Attorney, Agent, or Firm* — Paschall & Associates, LLC; James C. Paschall

(57) ABSTRACT

A process for hydrotreating a hydrocarbon residue stream is provided. The process comprises hydrotreating the hydrocarbon residue stream over a demetallation catalyst to demetallize the hydrocarbon residue stream to provide a demetallized hydrocarbon residue stream reduced in metals and sulfur concentration. The demetallized hydrocarbon residue stream is separated in a hot separator to provide an overhead vapor stream comprising hydrogen and a bottoms liquid stream. The bottoms liquid stream is split into a first liquid stream and a second liquid stream comprising low sulfur fuel oil. The second liquid stream is recovered as a low sulfur fuel oil product stream. The first liquid stream is hydrotreated over a desulfurization catalyst in the presence of at least a portion of the overhead vapor stream to provide a desulfurized hydrocarbon residue stream. The present process provides low sulfur fuel oil product stream comprising from about 0.3 wt % to about 1.5 wt % sulfur.

20 Claims, 1 Drawing Sheet

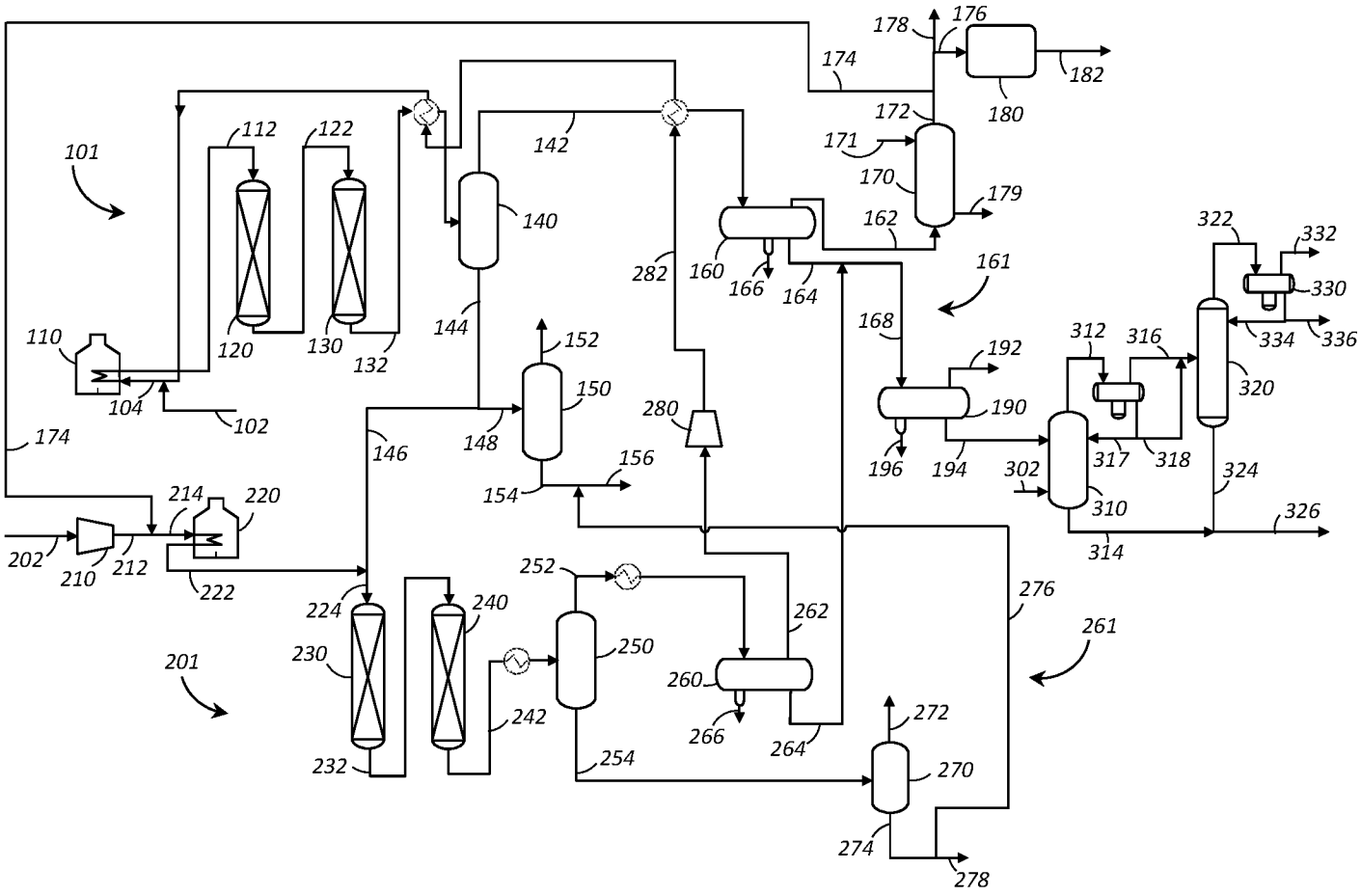
101
102
104
110
112
120
122
130
132
140
142
144
146
148
150
152
154
156
160
161
162
164
166
168
170
171
172
174
176
178
179
180
182
190
192
194
196
201
202
210
212
214
220
222
224
230
232
240
242
250
252
254
260
261
262
264
266
270
272
274
276
278
280
282
302
310
312
314
316
317
318
320
322
324
326
330
332
334
336

PROCESS FOR HYDROTREATING A HYDROCARBON RESIDUE STREAM

FIELD

The field relates to a process for hydrotreating a hydrocarbon residue stream. Particularly, the field relates to desulfurization of hydrocarbon residue streams.

BACKGROUND

Residue or resid streams are produced from the bottom of a fractionation column. Atmospheric residue (AR) is the bottom product of an atmospheric column. A vacuum residue (VR) is the bottom product of a vacuum distillation column. One application for residue streams is for producing a particular process feed. Residue streams are common terms to describe a hydrocarbonaceous stream having a boiling point greater than what is distillable in a distillation column. For example, related to a state of the art atmospheric distillation, residue oil has a majority of weight fraction having boiling points greater than 343° C. (650° F.). If related to a state of the art vacuum distillation, residue oil has a majority of weight fraction having boiling points greater than 524° C. (975° F.). One of the main application of the residue streams is in ships as fuel. The main type of "bunker" oil for ships is heavy fuel oil, derived as a residue from crude oil distillation. The residue contains sulfur which, following combustion in the engine, ends up in ship emissions. Sulphur oxides ($SO_x$) are known to be harmful to human health and environment. Limiting $SO_x$ emissions from ships will improve air quality and protect the environment.

International Maritime Organization (IMO) regulations to reduce sulfur oxides ($SO_x$) emissions from ships first came into force in 2005, under Annex VI of the International Convention for the Prevention of Pollution from Ships (known as the MARPOL convention). MARPOL convention aims for the prevention of pollution of the marine environment by ships from operational or accidental causes. MARPOL specifies limits on sulfur containing compounds; e.g., sulfur oxide ($SO_x$) emanating from ship exhausts and prohibits deliberate emission of, inter alia, sulfur containing compounds. Since then, the limits on sulfur oxides have been progressively tightened. Until Dec. 31, 2019, for ships operating outside Emission Control Areas, the limit for sulfur content of ships' fuel oil was 3.50% m/m (mass by mass). From Jan. 1, 2020, the limit for sulfur in fuel oil used on board ships operating outside designated emission control areas has been further reduced to 0.50% m/m (mass by mass). IMO regulations are designed to significantly reduce the amount of sulfur oxides emanating from ships and to provide major health and environmental benefits for the world, particularly for populations living close to ports and coasts.

A residue stream contains high boiling point hydrocarbon and heteroatom rich contaminants. Hydrotreating is a hydroprocessing process with the main purpose being to remove metals, sulfur and nitrogen from an atmospheric residue or a vacuum residue feed, so that the product is suitable for use as a fuel oil that meets environmental regulation or to produce an intermediate product which can be further processed in another refining processes. Hydrotreating is a process of applying catalytical hydrogenation reactions to sulfur, nitrogen containing sites as well as unsaturated carbon molecules to remove sulfur, nitrogen, and heavy metals from residue oil molecules, thus producing valuable finished fuel oil products or an intermediate product with suitable properties to be fed into other processes. In contrast with hydrotreating of a residue oil for heteroatom removal and aromatic/naphthenic ring saturation, other categories of hydroprocessing e.g., hydrocracking focuses on boiling point reduction, frequently targeting a mass fraction reduction above 50 wt % of the materials having boiling points at or above 524° C. (975° F.) in a residue stream to boiling points below 524° C. (975° F.).

Hydrotreating and hydrocracking are distinguished in terms of the inherent chemistry and operating conditions of each of these processes. Hydrotreating of a residue oil, frequently relies on hydrogenation reactions of unsaturated carbon-carbon ring structure or carbon-heteroatom bonds which is thermodynamically favored by lower temperature due to its exothermic nature. The net results of hydrotreating is to maximize heteroatom removal and carbon-carbon bond saturation, although minor boiling point reduction does occur due to molecule matrix breakdown. However, the boiling point shift for materials having boiling point 523° C. (975° F.) or greater is limited to about 20% to about 50% or lower solely due to hydrotreating reactions. In contrast, a viable hydrocracking process requires higher temperatures to occur due to the need to overcome bond energy for efficient reduction of boiling point as compared to hydrotreating. This is in particular correct for handling a residue feed thereby making residue feed hydrocracking process conditions distinguishingly different from a hydrotreating process conditions. A hydrocracking process handling residue feed operates far beyond a hydrotreating condition e.g., at a temperature of 426° C. (800° F.) or greater to achieve targeted 50% or more conversion of materials having boiling points 523° C. (975° F.) or greater. When hydrocracking process is used for a residue feed boiling point reduction, hydrocracking catalysts with more cracking functionality can be applied. However, it is found that hydrocracking catalysts have a significant shortened life when handling a residue feedstock, owing to severe catalyst deactivation due to the residue molecules.

In order to meet the various environmental conditions such as of MARPOL, refiners are weighing on technical solutions for producing fuel products to meet newer and more strict sulfur specifications. It would be highly desirable to have a residue oil hydrotreating process that can efficiently demetallize and desulfurize a residue stream below a certain sulfur specification. The dynamically changing fuel oil prices and the options of using the residue oil hydrotreating process to produce a range of quality and pricing streams provides an opportunity for refiners to optimize their processing and maximize profit at different price scenarios.

Accordingly, there is a need for an alternative approach for hydrotreating a residue stream to provide demetallized and desulfurized residue streams. Also, it is desirable to provide new apparatuses and processes for providing cost benefits in terms of lower capital and operational expenditures. Other desirable features and characteristics of the present subject matter will become apparent from the subsequent detailed description of the subject matter and the appended claims, taken in conjunction with the accompanying drawing and this background of the subject matter.

BRIEF SUMMARY

Various embodiments contemplated herein relate to processes and apparatuses for hydrotreating a hydrocarbon residue stream. The exemplary embodiments taught herein provide a process for hydrotreating a hydrocarbon residue stream.

In accordance with an exemplary embodiment, a process for hydrotreating a hydrocarbon residue stream is provided. The process comprises hydrotreating the hydrocarbon residue stream over a demetallation catalyst to demetallize the hydrocarbon residue stream in the presence of a hydrogen stream to provide a demetallized hydrocarbon residue stream reduced in metals and sulfur concentration. The demetallized hydrocarbon residue stream may be separated in a hot separator to provide an overhead vapor stream comprising hydrogen and a bottoms liquid stream. The bottoms liquid stream may be separated into a first liquid stream and a second liquid stream comprising low sulfur fuel oil. The second liquid stream may be recovered as a low sulfur fuel oil product stream. The first liquid stream may be further hydrotreated over a desulfurization catalyst in the presence of at least a portion of the overhead vapor stream to provide a highly desulfurized hydrocarbon residue stream.

In accordance with another exemplary embodiment, a process for hydrotreating a hydrocarbon residue stream is provided. The process comprises adding a hydrogen stream to the hydrocarbon residue stream. The hydrocarbon residue stream may be hydrotreated over a demetallation catalyst to demetallize the hydrocarbon residue stream in the presence of the hydrogen stream to provide a demetallized hydrocarbon residue stream reduced in metals and sulfur concentration. The demetallized hydrocarbon residue stream may be separated in a first stage hot separator to provide a first stage vapor stream comprising hydrogen and a first stage liquid stream. The first stage liquid stream may be split into a first liquid stream and a second liquid stream comprising low sulfur fuel oil. The second liquid stream may be recovered as a low sulfur fuel oil product stream. The first liquid stream may be hydrotreated over a desulfurization catalyst in the presence of at least portion of the first stage vapor stream to provide a highly desulfurized hydrocarbon residue stream. The desulfurized hydrocarbon residue stream may be separated in a second stage hot separator to provide a second stage vapor stream and a second stage liquid stream. At least a portion of the second stage liquid stream may be mixed with the low sulfur fuel oil product stream to meet a final low sulfur fuel oil product specification. The remaining portion of the second stage liquid stream may be withdrawn as a co-product stream that can be further processed.

The process of the present disclosure envisages providing a low sulfur fuel oil product that meets latest MARPOL regulation effective from Jan. 1, 2020. The process of the present disclosure provides a low sulfur fuel oil product having sulfur in amount of less than 0.5 wt %. The low sulfur fuel oil product obtained with the current process meets the current regulation of MARPOL regulation for sulfur that can be present in the fuel oil. Optionally, the current scheme can coproduce another residue product stream that can be suitable for other refining process, such as fluid catalytical cracking (FCC). The process for hydrotreating a hydrocarbon residue stream of the present disclosure also provides flexible refiners options in terms of product slates. The process applies conditions targeting at containments removal from residue oil products to be differentiated from conditions typical to hydrocracking processes targeting at least 50% conversion of materials having boiling points 523° C. (975° F.) or greater in residue oil feed, more specially the difference lies on operating temperature conditions.

These and other features, aspects, and advantages of the present disclosure will become better understood upon consideration of the following detailed description, drawings and appended claims.

BRIEF DESCRIPTION OF THE DRAWING

The various embodiments will hereinafter be described in conjunction with the following FIGURE, wherein like numerals denote like elements.

The FIGURE is a schematic diagram of a process and an apparatus for hydrotreating a hydrocarbon residue stream in accordance with an exemplary embodiment.

Definitions

As used herein, the term "column" means a distillation column or columns for separating one or more components of different volatilities. Unless otherwise indicated, each column includes a condenser on an overhead of the column to condense the overhead vapor and reflux a portion of an overhead stream back to the top of the column. Also included is a reboiler at a bottom of the column to vaporize and send a portion of a bottom stream back to the bottom of the column to supply fractionation energy. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column. Alternatively, a stripping stream may be used for heat input at the bottom of the column.

As used herein, the term "stream" can include various hydrocarbon molecules and other substances.

As used herein, the term "overhead stream" can mean a stream withdrawn in a line extending from or near a top of a vessel, such as a column.

As used herein, the term "bottoms stream" can mean a stream withdrawn in a line extending from or near a bottom of a vessel, such as a column.

As used herein, the term "passing" includes "feeding" and "charging" and means that the material passes from a conduit or vessel to an object.

As used herein, the term "portion" means an amount or part taken or separated from a main stream without any change in the composition as compared to the main stream. Further, it also includes splitting the taken or separated portion into multiple portions where each portion retains the same composition as compared to the main stream.

As used herein, the term "unit" can refer to an area including one or more equipment items and/or one or more sub-units. Equipment items can include one or more reactors or reactor vessels, heaters, separators, drums, exchangers, pipes, pumps, compressors, and controllers. Additionally, an equipment item, such as a reactor, dryer, or vessel, can further include one or more units or sub-units.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" or "directly" means that flow from the upstream component enters the downstream component without undergoing a compositional change due to physical fractionation or chemical conversion.

As used herein, the term "boiling point" means the boiling points of material that are more conveniently determined by gas chromatography simulated distillation methods, ASTM D-2887 and ASTM D-7169.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-7169.

As used herein, the term "T5", "T70" or "T95" means the temperature at which 5 mass percent, 70 mass percent or 95 mass percent, as the case may be, respectively, of the sample boils using ASTM D-7169.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator. The separator may be operated at higher pressure than the flash drum.

As used herein, the term "Conradson carbon residue" or "CCR" means the weight fraction of a carbonaceous residue after a standard oil pyrolysis test, using ASTM D189. CCR can be approximated by Micro Carbon residue (MCR) by ASTM D4530 in a similar test but using a much smaller amount of sample. CCR measures oil coking tendencies or degree of hydrogen deficiency.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description. The figures have been simplified by the deletion of a large number of apparatuses customarily employed in a process of this nature, such as vessel internals, temperature and pressure controls systems, flow control valves, recycle pumps, etc. which are not specifically required to illustrate the performance of the process. Furthermore, the illustration of the current process in the embodiment of a specific drawing is not intended to limit the process to specific embodiments set out herein.

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

A two-stage hydrotreating process for hydrotreating a hydrocarbon residue stream with a flexible product target is provided. The process for hydrotreating a hydrocarbon residue stream is addressed with reference to a process and an apparatus 100 according to an embodiment as shown in the FIGURE. Referring to the FIGURE, the process and apparatus 100 comprise a first stage hydrotreating unit 101, a first stage separation section 161, a second stage hydrotreating unit 201 and a second stage separation section 261. In an exemplary embodiment, the hydrocracking unit 101 may comprise a two-stage hydrocracking reactor. As shown in the FIGURE, a hydrocarbon residue stream in a residue line 102 and a first stage hydrogen stream in a first hydrogen line 282 are fed to the first stage hydrotreating unit 101.

In an embodiment, the hydrocarbon residue stream may comprise a hydrocarbon feed stream comprising a residue hydrocarbonaceous feedstock. The residue hydrocarbonaceous feedstock may be taken from a bottom of an atmospheric fractionation column or a vacuum fractionation column. In an exemplary embodiment, the hydrocarbon residue stream may include AR having an T5 between about 316° C. (600° F.) and about 399° C. (750° F.) and a T70 between about 510° C. (950° F.) and about 704° C. (1300° F.). VR having a T5 in the range between about 482° C. (900° F.) and about 565° C. (1050° F.) may also be a suitable feed. VR, atmospheric gas oils having T5 between about 288° C. (550° F.) and about 315° C. (600° F.) and vacuum gas oils (VGO) having T5 between about 316° C. (600° F.) and about 399° C. (750° F.) may also be blended with the AR to make a suitable residue feed. Deasphalted oil, visbreaker bottoms, clarified slurry oils, and shale oils may also be suitable residue feeds alone or by blending with the AR or the VR.

Typically, these residue feeds contain a significant concentration of metals which need to be removed by contacting HDM catalysts designed with large storage for metal containing by-products before deeper catalytic desulfurization can occur because the metals will adsorb on the HDS catalyst thereby reducing the surface are available for the reactions and with lack of storage thus making it inactive. Suitable residue feeds may include about 50 to about 500 wppm metals or less than about 200 wppm metals. Nickel, vanadium and iron are some of the typical metals in residue feeds. Residue feeds may comprise about 5 to about 200 wppm nickel, about 50 to about 500 wppm vanadium, about 1 to about 150 wppm iron and/or about 5 wt % to about 25 wt % Conradson carbon residue. Residue feeds may comprise about 10,000 wppm to about 60,000 wppm sulfur. Generally, the contaminants that can be present in the residue feeds and its Conradson carbon residue can be characterized by a range of residue oil specific chemical properties e.g., presence of asphaltenes and can be measured as the amount of materials which is insoluble in a low carbon number solvent, such as n-heptane or n-pentane. Accordingly, a hydrotreating process for a residue containing feedstock has unique and different consideration from a feed containing none or minimal residue. Frequently, refiners have a targeted product specification depending on downstream application of hydrotreated products, primarily on sulfur and metal content. In an exemplary embodiment, the process may employ a feed comprising at least 50 wt % materials having a boiling point greater than about 343° C. (650° F.). In another exemplary embodiment, the process may employ a feed comprising at least 8 wt % asphaltenes.

The first stage hydrogen stream in the first hydrogen line 282 may join the residue stream in the residue line 102 to provide the hydrocarbon residue stream in a residue feed line 104. The hydrocarbon residue stream in the residue feed line 104 may be heated in a fired heater 110. Optionally, the hydrocarbon residue stream in the residue feed line 104 and the first stage hydrogen stream in the first hydrogen line 282 may be passed separately to the fired heater 110. The heated hydrocarbon residue stream in the residue feed line 112 may be fed to a first demetallizing reactor 120 of the first stage hydrotreating unit 101.

Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. Hydrotreating on residue oil feed primarily applies hydrogeneration conditions for aromatic or naphthenic saturation and removal of sulfur, or nitrogen elements through chemical bond weakening initiated by bond saturation and subsequent chemical bond breaking between carbon and heteroatom molecules. Typically, the residue oil hydrotreating processes apply such hydrogeneration conditions including a hydrotreating temperature of 405° C. (760° F.) or lower. In contrast, the hydrocracking conditions frequently include a hydrocracking temperature of 426° C. (800° F.) or above to achieve boiling point reduction for residue molecules. The hydrocracking process of a residue oil may remove contaminants however, mostly through temperature enabled free radical cracking mechanism or much less through hydrogeneration reactions of unsaturated bonds due to thermodynamic limitations. Particularly, due to thermodynamic limitation, a process operating at residue feed hydrocracking conditions will not achieve appreciable unsaturated carbon-carbon bond hydrogenation, instead dehydrogenative condensation reaction will occur to an extent that frequently leads to excessive coke formation if no effective control measures are considered to prevent coke from building and depositing in the reactor system. Frequently, a process operating at residue feed hydrocracking conditions avoids applying fixed bed catalysts within reactors thus avoiding coke laydown or deactivation of any catalyst surface left static to reactor. Thus, frequently causing a short-lived operation making the process commercially unviable if used in conjunction with hydrotreating catalysts and process.

Hydrotreating is a process of applying catalytical hydrogenation reactions to sulfur, nitrogen containing sites as well as unsaturated carbon molecules to remove sulfur, nitrogen, and heavy metals from residue oil molecules. In the hydrotreating process, hydrocarbon aromatic ring molecules are stabilized by mesomerism. Typically, hydrogenation of aromatics rings is assisted by heterogenous catalysts which catalyze hydrogen dissociation and further attaches conjugate pi-bonds of an aromatic structure and transforms them to sigma carbon-carbon bonds forming naphthenic rings. Sulfur containing hydrocarbon molecules, especially thiophenic compounds also rely on active sites on catalysts to transfer, frequently through thiophenic ring opening or hydrogenation as critical steps. All hydrogeneration reactions are more thermodynamically favor by lower temperatures. Therefore, in industrial reactor conditions, hydroprocessing reactors operating at fixed bed supported catalysts, reactor temperatures are typically kept under 426° C. (800° F.) to achieve a reasonable degree of aromatic ring hydrogeneration, hydrodesulphurization or hydrodenitrogenation.

In contrast, cracking reactions involves carbon-carbon bond rupture and are thermodynamically favored by higher temperature. As a net result of cracking reactions, large molecules convert to smaller molecules causing a reduction in boiling point. Cracking reactions typical proceeds with thermal cracking and catalytic cracking. Thermal cracking proceeds by a free radical mechanism and appreciable conversions frequently require high temperatures, such as 426° C. (800° F.) and above. Catalytic cracking, and particularly, catalytic hydrocracking relies on an acidic catalyst-assisted carbonium ion mechanism. Under hydrocracking conditions, the primary cracking product formed through the carbonium ion mechanism remains saturated due to hydrogen supply and bifunctional catalysts.

The first stage hydrotreating unit 101 may comprise two demetallizing reactors comprising a first demetallizing reactor 120, and a second demetallizing reactor 130. More or less demetallizing reactors may also be used, and each demetallizing reactor 120 and 130 may comprise a part of a demetallizing reactor or comprise one or more demetallizing reactors. Each demetallizing reactor 120 and 130 may comprise part of a catalyst bed or one or more catalyst beds in one or more demetallizing reactor vessels. In the FIGURE, the first stage hydrotreating unit 101 comprises two demetallizing reactors 120 and 130 each comprising a single bed of HDM catalyst.

Fixed bed reactors may include supported catalysts or non-supported catalyst but that are strongly bound and shaped and are static relative to the reactor vessel where only liquid hydrocarbon feed and hydrogen rich gas feed flow through catalyst surface. Fixed bed reactors are commonly applied to hydrotreating or hydrogenation of contaminants containing petroleum feed. A fluidized bed reactor may also be used for residue oil hydrotreating where catalysts are frequently supported and fluidized inside the reactor but are retained inside reactor vessel except when being discharged after the catalyst is spent. A transport reactor may also be used for residue oil processing, but primarily designed for boiling point reduction or hydrocracking where catalysts are flowing through or traveling with liquid feed and hydrogen containing gas stream. In an exemplary embodiment, the demetallizing reactors 120 and 130 each comprise a fixed bed of HDM catalyst.

Suitable HDM catalysts that may be used in the first stage hydrotreating unit 101 may include any conventional residue hydrotreating catalysts and include those which are comprised of at least one Group VIII metal, or iron, cobalt and nickel, or nickel and/or cobalt and at least one Group VI metal e.g. molybdenum and tungsten, on a high surface area support material such as alumina. More than one type of hydrotreating catalyst may also be used in the same reaction vessel or catalyst bed. The Group VIII metal may be present on the HDM catalyst in an amount ranging from about 1 wt % to about 10 wt %, or from about 2 wt % to about 5 wt %. The Group VI metal will typically be present on the HDM catalyst in an amount ranging from about 1 wt % to about 20 wt %, or from about 2 wt % to about 10 wt %. Also, the suitable catalysts that may be used in the first stage hydrotreating unit 101 does not include compounds enhancing catalysts acidity intended for boiling point reduction purpose. In contrast, catalysts used in a hydrocracking process frequently contain a solid acid with examples including crystalline silica alumina, e.g., molecule sieve or zeolitic material; a chlorinated alumina; and an amorphous silica-alumina. Enhanced acidic functions perform significant carbon-carbon bond cleavage frequently through formation of carbonium ions enabled by added acidic function in the catalysts. A hydrocracking catalyst with enhanced acidity can be 2 to 100 times stronger than the natural weak acidity a hydrotreating catalysts possess.

In an embodiment, the first demetallizing reactor 120, and the second demetallizing reactor 130 may comprise a HDM catalyst comprising cobalt and molybdenum on gamma alumina. The HDM catalyst in the first demetallizing reactor 120, and the second demetallizing reactor 130 may have a bimodal pore size distribution with at least about 25% of the pores on the catalyst particle being characterized as small pores, in the micropore or mesopore range of about 5 to no more than about 30 nm and at least about 25% of the pores being characterized as large pores, in the mesopore or macropore range of greater than about 30 to about 100 nm. The large pores are more suited for demetallation and the small pores are more suited for desulfurization. The ratio of large pores to small pores may decrease from upstream to downstream in the first demetallizing reactor 120, and the second demetallizing reactor 130. In another embodiment, the first demetallizing reaction 120 may have a larger ratio of large pores to small pores than the second demetallizing reactor 130.

The hydrocarbon residue stream in line 104 may be fed to the first demetallizing reactor 120, and the second demetallizing reactor 130. It is contemplated that more or less demetallizing reactors may be provided in the first stage hydrotreating unit 101. In the first demetallizing reactor 120, the hydrocarbon residue stream in line 104 or the heated hydrocarbon residue stream in the residue feed line 112 is hydrotreated over a demetallation catalyst to demetallize the hydrocarbon residue stream in line 104 or the heated hydrocarbon residue feed stream in the residue feed line 112 in the presence of the first stage hydrogen stream to provide a demetallized hydrocarbon residue stream reduced in metals and sulfur concentration. A hydrotreated/demetallized effluent stream in line 122 may be passed to the second demetallizing reactor 130. The first demetallizing reactor 120, and the second demetallizing reactor 130 are intended to demetallize the hydrocarbon residue feed stream 104 or the heated hydrocarbon residue stream 112, so to reduce the metals concentration by about 40 wt % to about 100 wt % and typically about 65 wt % to about 95 wt % to produce the demetallized hydrocarbon residue stream exiting one, some or all of the first demetallizing reactor 120, and the second demetallizing reactor 130. The metal content of the demetallized hydrocarbon residue stream may be less than about 50 wppm or between about 1 and about 25 wppm. The first demetallizing reactor 120, and the second demetallizing reactor 130 may also desulfurize and denitrogenate the hydrocarbon residue stream. In an exemplary embodiment, the first stage hydrotreating unit 101 may desulfurize from about 50 wt % to about 80 wt % sulfur present in the hydrocarbon residue stream. A demetallized hydrocarbon residue stream reduced in metals and sulfur concentration relative to the residue feed stream fed to the reactor may exit the first demetallizing reactor 120, and the second demetallizing reactor 130.

Reaction conditions in each of the first demetallizing reactor 120, and the second demetallizing reactor 130 may include a temperature from about 66° C. (151° F.) to about 426° C. (800° F.), or about 316° C. (600° F.) to about 418° C. (785° F.) or about 343° C. (650° F.) to about 399° C. (750° F.), a pressure from about 2.1 MPa (gauge) (300 psig) to about 27.6 MPa (gauge) (4000 psig), or about 13.8 MPa (gauge) (2000 psig) to about 20.7 MPa (gauge) (3000 psig), a liquid hourly space velocity of the fresh residue feed from about 0.1 $hr^{-1}$ to about 5 $hr^{-1}$, or from about 0.2 $hr^{-1}$ to about 2 $hr^{-1}$, and a hydrogen rate of about 168 $Nm^3/m^3$ (1,000 scf/bbl) to about 1,680 $Nm^3/m^3$ oil (10,000 scf/bbl), or about 674 $Nm^3/m^3$ oil (4,000 scf/bbl) to about 1,011 $Nm^3/m^3$ oil (6,000 scf/bbl). The current process does not observe appreciable boiling point shift under the given reaction conditions for the first stage hydrotreating unit 101. The boiling point range for the feed in line 112 and the product in demetallized hydrocarbon residue stream in line 122 remain same. In an exemplary embodiment, typically no more than about 50% of the feed in line 112 having a boiling point above about 523° C. (975° F.) may be converted to products having a boiling point at or below about 523° C. (975° F.). Particularly, no more than about 40% and suitably no more than about 20% of the feed in line 112 having a boiling point above about 523° C. (975° F.) may be converted to products having a boiling point at or below about 523° C. (975° F.).

A demetallized hydrocarbon residue stream in line 132 may exit the second demetallizing reactor 130 or the last demetallizing reactor of the first stage hydrotreating unit 101. The demetallized hydrocarbon residue stream in line 132 may be separated in a first stage hot separator 140 to provide a first stage overhead vapor stream comprising hydrogen in line 142 and a first stage bottoms liquid stream in line 144. The demetallized hydrocarbon residue stream in line 132 may be cooled by heat exchange with the first stage hydrogen stream in line 282 and enter the first stage separation section 161 comprising a first stage hot separator 140. The first stage separation section 161 comprises one or more separators in downstream communication with the first stage hydrotreating unit 101 including the first stage hot separator 140. The demetallized hydrocarbon residue stream in line 132 may be cooled in a heat exchanger and passed to the first stage hot separator 140. Accordingly, the first stage hot separator 140 is in downstream communication with the first demetallizing reactor 120, and the second demetallizing reactor 130.

As a consequence of the reactions taking place in the first stage hydrotreating unit 101 wherein nitrogen and sulfur are reacted from the feed, ammonia and hydrogen sulfide are formed. The first stage hot separator 140 removes the hydrogen sulfide and ammonia from the first stage bottoms liquid stream in the first hot bottoms line 144 into the first stage overhead vapor stream in the first hot overhead line 142 to provide a sweetened, demetallized residue stream for desulfurization in the second stage hydrotreating unit 201.

The first stage hot separator 140 separates the demetallized hydrocarbon residue stream 132 to provide a hydrocarbonaceous first stage overhead vapor stream in a first hot overhead line 142 and a hydrocarbonaceous, first stage bottoms liquid stream in a first hot bottoms line 144. The first stage overhead vapor stream in line 142 comprises the bulk of the hydrogen sulfide from the demetallized residue stream. The first stage bottoms liquid stream in line 144 has a smaller concentration of hydrogen sulfide than the demetallized hydrocarbon residue stream in line 132. A second stage hydrogen stream may be taken from the first stage overhead vapor stream in line 142.

The first stage hot separator 140 may operate at a temperature from about 177° C. (350° F.) to about 371° C. (700° F.) and preferably operates at about 232° C. (450° F.). to about 315° C. (600° F.). The first stage hot separator 140 may be operated at a slightly lower pressure than the second demetallizing reactor 130 accounting for pressure drop through intervening equipment. The first stage hot separator 140 may be operated at pressures between about 3.4 MPa (gauge) (493 psig) and about 20.4 MPa (gauge) (2959 psig). The hydrocarbonaceous, first stage overhead vapor stream in the first hot overhead line 142 may have a temperature of the operating temperature of the first stage hot separator 140.

The first stage overhead vapor stream in the first hot overhead line 142 may be cooled by heat exchange with the first stage hydrogen stream in line 282 before entering a first cold separator 160. The first cold separator 160 may be in downstream communication with the first hot overhead line 142. The first stage overhead vapor stream in line 142 may be separated in the first cold separator 160 to provide a first cold vapor stream comprising a hydrogen-rich gas stream including ammonia and hydrogen sulfide in a first cold overhead line 162 and a first cold liquid stream in a first cold bottoms line 164. The first cold separator 160 serves to separate hydrogen rich gas from hydrocarbon liquid in the first stage overhead vapor stream in line 142 for recycle to the second stage hydrotreating unit 201. The first cold separator 160, therefore, is in downstream communication with the first stage overhead vapor stream in the first hot overhead line 142 of the first stage hot separator 140.

The first cold separator 160 may be operated at a temperature from about 38° C. (100° F.) to about 66° C. (150° F.), or from about 46° C. (115° F.). to about 63° C. (145° F.), and just below the pressure of the second demetallizing reactor 130 or the last demetallizing reactor of the first stage hydrotreating unit 101 and the first stage hot separator 140 accounting for pressure drop through intervening equipment to keep hydrogen and light gases in the overhead and normally liquid hydrocarbons in the bottoms. The first cold separator 160 may be operated at pressures between about 3 MPa (gauge) (435 psig) and about 20 MPa (gauge) (2,901 psig). The first cold separator 160 may also have a boot for collecting an aqueous phase. The aqueous phase may be taken from the boot in line 166. The first cold liquid stream in the first cold bottoms line 164 may have a temperature of the operating temperature of the first cold separator 160. The first cold liquid stream in the first cold bottoms line 164 may be delivered to a cold flash drum 190, in an embodiment after mixing with a second cold liquid stream in a second cold bottoms line 264. The cold flash drum 190 may be in downstream communication with the first cold bottoms line 164 of the first cold separator 160.

The first cold vapor stream in the first cold overhead line 162 is rich in hydrogen. Thus, hydrogen can be recovered from the first cold vapor stream in line 162. However, the first cold vapor stream in line 162 comprises much of the hydrogen sulfide and ammonia separated from the demetallized residue stream in line 132. The first cold vapor stream in the cold overhead line 162 may be passed through a trayed or packed recycle scrubbing column 170 where it may be scrubbed by means of a scrubbing extraction liquid such as an aqueous solution fed by line 171 to remove acid gases including hydrogen sulfide and carbon dioxide by extracting them into the aqueous solution. The aqueous solutions may include lean amines such as alkanolamines DEA, MEA, and MDEA. Other amines may also be used in place of or in addition to the lean amines. The lean amine contacts the first cold vapor stream in line 162 and absorbs acid gas contaminants such as hydrogen sulfide and carbon dioxide. The resultant "sweetened" first cold vapor stream is taken out from an overhead outlet of the recycle scrubber column 170 in a recycle scrubber overhead line 172, and a rich amine is taken out from the bottoms at a bottom outlet of the recycle scrubber column in a recycle scrubber bottoms line 179. The spent scrubbing liquid from the bottoms may be regenerated and recycled back to the recycle scrubbing column 170 in line 171. The scrubbed hydrogen-rich stream emerges from the scrubber via the recycle scrubber overhead line 172. A portion of the scrubbed hydrogen-rich stream may be recycled in recycle line 174 and added to the make-up hydrogen stream in make-up line 212 for supplying a second stage hydrogen stream in second hydrogen line 214 to the second stage hydrotreating unit 201. Accordingly, the second stage hydrogen stream in second hydrogen line 214 may be taken from the first stage overhead vapor stream in the first hot overhead line 142 and the first cold vapor stream in the first cold overhead line 162. A portion of the scrubbed hydrogen-rich stream in the recycle scrubber overhead line 172 may be purged in line 178. Another portion of the hydrogen-rich stream in the recycle scrubber overhead line 176 may be forwarded to a hydrogen recovery unit 180. The recycle scrubbing column 170 may be operated with a gas inlet temperature between about 38° C. (100° F.) and about 66° C. (150° F.) and an overhead pressure of about 3 MPa (gauge) (435 psig) to about 20 MPa (gauge) (2900 psig).

A demetallized first stage bottoms liquid stream exits the first stage hydrotreating unit 101 and the first stage separation section 161 in the first stage bottoms liquid stream transported in the first hot bottoms line 144 with a reduced concentration of metals, sulfur and nitrogen relative to the hydrocarbon residue stream in line 102.

The first stage bottoms liquid stream in the first hot bottoms line 144 may be split into a first liquid stream in line 146 and a second liquid stream comprising low sulfur fuel oil in line 148. The low sulfur fuel oil product may be separated from the second liquid stream in line 148. In an embodiment, the second liquid stream in line 148 may be passed to a flash drum 150. In the flash drum 150 low sulfur fuel oil product may be separated from the second liquid stream in line 148. The low sulfur fuel oil product stream is taken from the bottoms of the flash drum in bottoms line 154 and a flash overhead stream is taken from the overhead in an overhead of the flash drum in overhead line 152. In an exemplary embodiment, the low sulfur fuel oil product stream in line 154 comprises sulfur in an amount from about 0.3 wt % to about 1.5 wt %. In another exemplary embodiment, the low sulfur fuel oil product stream in line 154 comprises sulfur in an amount from about 0.4 wt % to about 1.4 wt %. In yet another exemplary embodiment, the low sulfur fuel oil product stream in line 154 comprises sulfur in an amount from about 0.05 wt % to about 0.5 wt %.

In accordance with the present process, the low sulfur fuel oil product stream 154, separated from the second liquid stream in line 148, comprises sulfur in an amount from about 0.05 wt % to about 1.5 wt %. The low sulfur fuel oil product stream 154 may be taken as low sulfur fuel oil product to be used as fuel oil meeting the sulfur regulation of MARPOL convention. In another embodiment, the second liquid stream in line 148 may be sent directly as a low sulfur fuel oil product stream or taken as a main component of a fuel oil pool or as part of a final blend.

A make-up hydrogen stream in line 202 may be passed to a compressor to provide a compressed make-up hydrogen stream in line 212. The hydrogen-rich recycle stream in line 174 may be combined with the make-up hydrogen stream in line 212 to provide the second stage hydrogen stream in second hydrogen line 214. The second stage hydrogen stream in line 214 may be heated in a fired heater 220. The heated second stage hydrogen stream in line 222 may be mixed with a demetallized first liquid stream in line 146 and fed to the second stage hydrotreating unit 201.

The first liquid stream in line 146 is at elevated temperature and may not need further heating before entering the second stage hydrotreating unit 201. In an embodiment, the second stage hydrotreating unit 201 comprises a first desulfurization reactor 230 and a second desulfurization reactor 240 which may include a hydrodesulfurization (HDS) catalyst. More or less desulfurization reactors may be used. The HDS catalyst may comprise nickel or cobalt and molybdenum on gamma alumina support to convert organic sulfur to hydrogen sulfide. The HDS catalyst may have a monomodal or unimodal distribution of mesoporous pore sizes with at least 50% of the pores on the catalyst particle being in the range of 10 to 50 nm. Also, the suitable catalysts that may be used in the second stage hydrotreating unit 201 do not include compounds that have enhanced acidity intended for boiling point reduction.

The first desulfurization reactor 230 and the second desulfurization reactor 240 may be operated in series with an effluent stream in line 232 from the first desulfurization reactor 230 cascading into an inlet of the second desulfurization reactor 240. The first desulfurization reactor 230 and the second desulfurization reactor 240 desulfurizes the demetallized residue feed present in the first liquid stream in line 146 to reduce the sulfur concentration of the first liquid stream in line 146 by about 40 wt % to about 100 wt % and typically about 65 wt % to about 95 wt % to produce a desulfurized hydrocarbon residue stream in line 242 exiting the second desulfurization reactor 240. Also, the second stage hydrotreating unit 201 will be at sweeter gas environment due to gas cleaning up compared to the first stage hydrotreating unit 101. In the FIGURE, the second stage hydrotreating unit 201 comprises two desulfurization reactors 230 and 240 each comprising a single bed of HDM catalyst. In an exemplary embodiment, the desulfurization reactors 230 and 240 each comprises a fixed bed of HDM catalyst.

The first desulfurization reactor 230 and the second desulfurization reactor 240 may be operated at a temperature from about 66° C. (151° F.) to about 426° C. (800° F.), or about 316° C. (600° F.) to about 418° C. (785° F.) or about 343° C. (650° F.) to about 399° C. (750° F.), a pressure from about 2.1 MPa (gauge) (300 psig) to about 27.6 MPa (gauge) (4000 psig), or from about 13.8 MPa (gauge) (2000 psig) to about 20.7 MPa (gauge) (3000 psig), a liquid hourly space velocity of the fresh residue feed from about 0.1 $hr^{-1}$ to about 5 $hr^{-1}$, or from about 0.2 $hr^{-1}$ to about 2 $hr^{-1}$, and a hydrogen rate of about 168 $Nm^3/m^3$ (1,000 scf/bbl) to about 1,680 $Nm^3/m^3$ oil (10,000 scf/bbl), or from about 674 $Nm^3/m^3$ oil (4,000 scf/bbl) to about 1,011 $Nm^3/m^3$ oil (6,000 scf/bbl). The current process does not observe any boiling point shift under the given reaction conditions for the second stage hydrotreating unit 201. The boiling point range for the feed in line 112 or in line 224 and the product in desulfurized hydrocarbon residue stream in line 242 remain same. In an exemplary embodiment, no more than about 5% of the feed in line 112 or in line 224 having a boiling point above about 524° C. (975° F.) may be converted to products having a boiling point at or below about 524° C. (975° F.).

The desulfurized hydrocarbon residue stream may exit the second desulfurization reactor 240 in the desulfurized effluent line 242, be cooled by heat exchange perhaps with the first stage hydrogen stream in line 282 (not shown) and enter the second stage separation section 261 comprising a second stage hot separator 250. The second stage separation section 261 comprises one or more separators in downstream communication with the second stage hydrotreating unit 201 including the second stage hot separator 250. The desulfurized hydrocarbon residue stream in line 242 delivers a relatively cooled desulfurized effluent stream to the second stage hot separator 250. Accordingly, the second stage hot separator 250 is in downstream communication with the first desulfurization reactor 230 and the second desulfurization reactor 240.

In accordance with the present disclosure, the operating conditions of the first stage hydrotreating unit 101 and the second stage hydrotreating unit 201 are differentiated from typical operating conditions of hydrocracking processes targeting at least 50% conversion of materials having boiling point 524° C. (975° F.) or greater present in the residue oil feed. Particularly, the temperature of the first stage hydrotreating unit 101 and the second stage hydrotreating unit 201 is lower compared to the typical operating temperature of the hydrocracking processes.

The second stage hot separator 250 separates the desulfurized hydrocarbon residue stream in line 242 to provide a hydrocarbonaceous second stage vapor stream in a second hot overhead line 252 and a hydrocarbonaceous second stage liquid stream in a second hot bottoms line 254. The second stage hot separator 250 may operate at a temperature from about 177° C. (350° F.) to about 371° C. (700° F.) or from about 232° C. (450° F.) to about 315° C. (600° F.). The second stage hot separator 250 may be operated at a slightly lower pressure than the second desulfurization reactor 240 accounting for pressure drop through intervening equipment. The second stage hot separator 250 may be operated at pressures between about 3.4 MPa (gauge) (493 psig) and about 20.4 MPa (gauge) (2959 psig). The second stage vapor stream in the second hot overhead line 252 may have a temperature of the operating temperature of the second stage hot separator 250. The second stage liquid stream in the second hot bottoms line 254 may be fed to a hot flash drum 270 to provide a hot flash vapor stream in line 272 and a hot flash liquid stream in line 274.

The second stage vapor stream in the second hot overhead line 252 may be cooled by heat exchange before entering a second cold separator 260. The second cold separator 260 is in downstream communication with the second hot overhead line 252 of the second stage hot separator 250.

The second stage vapor stream in line 252 may be separated in the second cold separator 260 to provide a second cold vapor stream in line 262 and a second cold liquid stream in a second cold bottoms line 264. The second cold vapor stream in line 262 may be recycled to the first stage hydrotreating unit 101 as the first stage hydrogen stream. The second stage cold separator 260 serves to separate hydrogen rich gas from hydrocarbon liquid in the second stage vapor stream in line 252 into the second cold vapor stream for recycle to the first stage hydrotreating unit 101 in the second cold overhead line 262. The second cold vapor stream in line 262 which is rich in hydrogen may be compressed in a compressor 280 before recycling it as the first stage hydrogen stream in the first hydrogen line 282. Accordingly, the first stage hydrogen stream in the first hydrogen line 282 may be taken from the second stage vapor stream in second hot overhead line 252 and the second cold vapor stream in the second cold overhead line 262.

The second stage liquid stream in the second hot bottoms line 254 may be let down in pressure and flashed in a hot flash drum 270 to provide a hot flash vapor stream of light ends in a hot flash overhead stream in line 272 and a hot flash liquid stream in a hot flash bottoms line 274. The hot flash drum 270 may be in direct, downstream communication with the second hot bottoms line 254 and in downstream communication with the second stage hydrotreating unit 201. The hot flash liquid stream in line 274 may be split into a first flash liquid stream in line 276 and a second flash liquid stream in line 278.

The hot flash drum 270 may be operated at the same temperature as the second hot separator 250 but at a lower pressure of between about 1.4 MPa (gauge) (200 psig) and about 6.9 MPa (gauge) (1000 psig), or no more than about 3.8 MPa (gauge) (550 psig). The hot flash liquid stream in the hot flash bottoms line 274 may have a temperature of the operating temperature of the hot flash drum 270.

The desulfurized hydrocarbon residue stream in line 242 is produced from the second stage hydrotreating unit 201 which employs HDS catalyst with a monomodal or unimodal distribution of mesoporous pore sizes having higher activity for hydrogenation. Therefore, the desulfurized hydrocarbon residue stream in line 242 second stage product is highly desulfurized. Also, the desulfurized hydrocarbon residue stream in line 242 is highly refined in terms of nitrogen, metal, Conradson carbon residue, and asphaltene content that can be present in the hydrocarbon residue stream in line 242. The hot flash liquid stream in line 274 obtained downstream from the separation of desulfurized hydrocarbon residue stream in line 242, is also highly desulfurized as well as highly cleaned in terms of nitrogen, metal, Conradson carbon residue, and asphaltene content of the stream. In an embodiment, the hot flash liquid stream in line 274 may comprise sulfur in an amount from about 0.1 wt % to about 0.4 wt %. The latest MARPOL regulations from Jan. 1, 2020 have reduced the amount of sulfur that can be present in the fuel oil. The new MARPOL regulations limits sulfur present in the fuel oil to 0.50% m/m. To meet the desired limit for the amount of sulfur present in the low sulfur fuel oil product stream, a trim stream may be split from the highly desulfurized and cleaned hot flash liquid stream 274 and mixed with the second liquid stream in line 148 to recover the low sulfur fuel oil product stream with desired amount of sulfur. Also, a remaining portion of the hot flash liquid stream 274 may be processed downstream to produce other desired products. In accordance with an embodiment, a first flash liquid stream in line 276 may be split from the hot flash liquid stream 274. The first flash liquid stream in line 276 may be blended with the low sulfur fuel oil product stream in line 154 to provide a final low sulfur fuel oil product stream in line 156. In an exemplary embodiment, the final low sulfur fuel oil product stream in line 156 comprises sulfur in an amount from about 0.05 wt % to about 0.5 wt %. Applicant has discovered that mixing the first flash liquid stream in line 276 with the low sulfur fuel oil product stream in line 154 can reduce the HDM catalyst volume required in the first stage hydrotreating unit 101 and accordingly the size of first stage hydrotreating unit 101. Because, the first flash liquid stream in line 276 is obtained from the desulfurized effluent line 242 which is highly desulfurized owing to desulfurization in the second stage hydrotreating unit 201 of HDS catalyst. Accordingly, the catalyst volume of the HDM catalyst can be comparatively reduced to demetallize and desulfurize the hydrocarbon residue stream in the first stage hydrotreating unit 101.

In another exemplary embodiment, the final low sulfur fuel oil product stream in line 156 comprises sulfur in an amount from about 0.1 wt % to about 0.5 wt %. In yet another exemplary embodiment, the final low sulfur fuel oil product stream in line 156 comprises sulfur in an amount from about 0.2 wt % to about 0.5 wt %. In still another exemplary embodiment, the final low sulfur fuel oil product stream in line 156 comprises sulfur in an amount from about 0.3 wt % to about 0.5 wt %. The final low sulfur fuel oil product stream in line 156 may be passed to a fuel oil pool.

The second flash liquid stream in line 278 comprising a portion of the hot flash liquid stream in line 274, is highly desulfurized and cleaned in terms of nitrogen, metal, Conradson carbon residue, and asphaltene content of the stream. Therefore, the current process may produce a minimum of two liquid product streams, a low sulfur fuel product stream 154 and another highly desulfurized and refined stream 278 having a lower sulfur concentration compared to the low sulfur fuel product stream that may be further processed downstream to produce other desirable desulfurized and demetallized products. Accordingly, the second flash liquid stream in line 278 may be separated and further processed to produce other products e.g. for gasoline and in petrochemical production. In an embodiment, the second flash liquid stream in line 278 may be passed to a fluid catalytic cracking (FCC) process. The current process also provides flexible product target. To provide a low sulfur fuel meeting the MARPOL regulation for the sulfur amount, a suitable amount of the highly desulfurized first flash liquid stream 276 separated from the hot flash liquid stream in line 274 can be mixed with the low sulfur fuel oil product stream 154.

The second stage cold separator 260 may be operated at about 38° C. (100° F.) to about 66° C. (150° F.), or from about 46° C. (115° F.) to about 63° C. (145° F.), and below the pressure of the second desulfurization reactor 240 and the second stage hot separator 250 accounting for pressure drop through intervening equipment to keep hydrogen and light gases in the overhead and normally liquid hydrocarbons in the bottoms. The second stage cold separator 250 may be operated at pressures between about 3 MPa (gauge) (435 psig) and about 20 MPa (gauge) (2,901 psig). The second stage cold separator 250 may also have a boot for collecting an aqueous phase in line 266. The second cold liquid stream in a second cold bottoms line 264 may have a temperature of the operating temperature of the cold separator 260. The second cold liquid stream in the second cold bottoms line 264 may be delivered to the cold flash drum 190 and be separated together with the first cold liquid stream in the first cold bottoms line 164 in the cold flash drum 190. In an embodiment, the second cold liquid stream in the second cold liquid bottoms line 264 may be mixed with the first cold liquid stream in the first cold bottoms line 164 to provide a combined cold liquid stream in line 168. The combined cold liquid stream in line 168 may be separated in cold flash drum 190.

In an embodiment, the second cold liquid stream in the second cold bottoms line 264 may be sent to fractionation. In another embodiment, the second cold liquid stream in line 264 may be let down in pressure and flashed in the cold flash drum 190 to separate fuel gas from the second cold liquid stream in the second cold bottoms line 264 and provide a cold flash liquid stream in a cold flash bottoms line 194. The cold flash drum 190 may be in direct downstream communication with the second cold bottoms line 264 of the cold separator 260. In an exemplary embodiment, the cold flash drum 190 may separate the first cold liquid stream in the first cold bottoms line 164 to provide a fuel gas stream in a cold flash overhead line 192 and a cold flash liquid stream in a cold flash bottoms line 194. The second cold liquid stream in the second cold bottoms line 264 and the first cold liquid stream in the first cold bottoms line 164 may be flash separated in the cold flash drum 190 together. The cold flash liquid stream in the cold flash bottoms line 194 may be sent to product fractionation which may be preceded by stripping to remove hydrogen sulfide from product streams including a desulfurized residue stream. As shown, a stripping column 310 and a fractionation column 320 may be present in downstream communication with the cold flash drum 190 and the cold flash bottoms line 194. In another exemplary embodiment, the first cold liquid stream in the first cold bottoms line 164 and the second cold liquid stream in the second cold bottoms line 264 may be fractionated in the fractionation column 320 to provide a bottoms stream in line 326. The cold flash liquid stream in the cold flash bottoms line 194 may be passed to the stripping column 310. A suitable stripping media may also be passed to the stripping column 310 in line 302. In an exemplary embodiment, the stripping media may be steam. A stripped cold flash liquid stream in line 312, after passing via an overhead receiver of the stripping column 310, may be passed to the fractionation column 320 in lines 316 and 318 either combinedly or separately. A reflux stream in line 317 may be passed to the stripping column 310. The stripped cold flash liquid stream may be fractionated in the fractionation column 320 to provide an overhead stream in line 322. The overhead stream in line 322 may be passed to an overhead receiver 330 wherein the overhead stream 322 may be separated into receiver overhead vapor stream in line 332 and receiver bottoms liquid stream in line 336. A reflux stream in line 334 may be passed to the fractionation column 320. A bottoms stream in line 314 from the stripping column 310 may be combined with a bottoms stream in line 324 from the fractionation column 320 to provide a combined bottoms stream in line 326. In an exemplary embodiment, the bottoms stream in line 326 may comprise sulfur in an amount from about 0.01 wt % to about 0.25 wt %. The combined bottoms stream in line 326 may be hydrotreated in a downstream hydrotreating unit (not shown). A hydrotreated bottoms stream may be further processed to produce other products. In an exemplary embodiment, the hydrotreated bottoms stream may be passed to a fluid cracking process (FCC). In another exemplary embodiment, a portion of the bottoms stream in line 326 may be mixed with the low sulfur fuel oil product stream in line 154.

The cold flash drum 190 may be operated at the same temperature as the second cold separator 260 but typically at a lower pressure of between about 1.4 MPa (gauge) (200 psig) and about 6.9 MPa (gauge) (1000 psig) or between about 3.0 MPa (gauge) (435 psig) and about 3.8 MPa (gauge) (550 psig). A flashed aqueous stream may be removed from a boot of the cold flash drum 190 in line 196. The cold flash liquid stream in the cold flash bottoms line 194 may have the same temperature as the operating temperature of the cold flash drum 190.

SPECIFIC EMBODIMENTS

While the following is described in conjunction with specific embodiments, it will be understood that this description is intended to illustrate and not limit the scope of the preceding description and the appended claims.

A first embodiment of the present disclosure is a process for hydrotreating a hydrocarbon residue stream comprising hydrotreating the hydrocarbon residue stream over a demetallation catalyst to demetallize the hydrocarbon residue stream in the presence of a first hydrogen stream to provide a demetallized hydrocarbon residue stream reduced in metals and sulfur concentration; separating the demetallized hydrocarbon residue stream in a hot separator to provide an overhead vapor stream comprising hydrogen and a bottoms liquid stream; splitting the bottoms liquid stream into a first liquid stream and a second liquid stream comprising low sulfur fuel oil; recovering the second liquid stream as a low sulfur fuel oil product stream; and hydrotreating the first liquid stream over a desulfurization catalyst in the presence of a second hydrogen stream to provide a desulfurized hydrocarbon residue stream. An embodiment of the present disclosure is one, any or all of prior embodiments in this paragraph up through the first embodiment in this paragraph, wherein recovering the second liquid stream as a low sulfur fuel oil product stream comprises separating the second liquid stream to provide a flash overhead stream and the low sulfur fuel oil product stream. An embodiment of the present disclosure is one, any or all of prior embodiments in this paragraph up through the first embodiment in this paragraph, wherein the low sulfur fuel oil product stream comprises sulfur in an amount from about 0.3 wt % to about 1.5 wt %. An embodiment of the present disclosure is one, any or all of prior embodiments in this paragraph up through the first embodiment in this paragraph further comprising separating the desulfurized hydrocarbon residue stream to provide a vapor stream and a liquid stream. An embodiment of the present disclosure is one, any or all of prior embodiments in this paragraph up through the first embodiment in this paragraph further comprising separating the liquid stream to provide a hot flash vapor stream and a hot flash liquid stream. An embodiment of the present disclosure is one, any or all of prior embodiments in this paragraph up through the first embodiment in this paragraph further comprising splitting the hot flash liquid stream into a first flash liquid stream and a second flash liquid stream; and mixing the first flash liquid stream with the second liquid stream to produce the low sulfur fuel oil product stream comprising from about 0.05 wt % to about 0.5 wt % sulfur. An embodiment of the present disclosure is one, any or all of prior embodiments in this paragraph up through the first embodiment in this paragraph further comprising separating the vapor stream in a second cold separator to provide a second cold vapor stream and a second cold liquid stream and taking the first hydrogen stream from the second cold vapor stream. An embodiment of the present disclosure is one, any or all of prior embodiments in this paragraph up through the first embodiment in this paragraph, wherein an entirety of the second cold vapor stream is taken as the first hydrogen stream. An embodiment of the present disclosure is one, any or all of prior embodiments in this paragraph up through the first embodiment in this paragraph further comprising separating the overhead vapor stream in a first cold separator to provide a first cold vapor stream and a first cold liquid stream. An embodiment of the present disclosure is one, any or all of prior embodiments in this paragraph up through the first embodiment in this paragraph further comprising separating the first cold vapor stream into a purge stream and a recycle stream; and taking the recycle stream as the second hydrogen stream. An embodiment of the present disclosure is one, any or all of prior embodiments in this paragraph up through the first embodiment in this paragraph further comprising separating the first cold liquid stream and the second cold liquid stream to provide a fuel gas stream and a cold flash liquid stream and subjecting the cold flash liquid stream to fluid catalytic cracking. An embodiment of the present disclosure is one, any or all of prior embodiments in this paragraph up through the first embodiment in this paragraph further comprising fractionating the cold flash liquid stream in a fractionation column to provide a bottoms stream; and mixing the bottoms stream with the low sulfur fuel oil product stream. An embodiment of the present disclosure is one, any or all of prior embodiments in this paragraph up through the first embodiment in this paragraph further comprising adding the second liquid stream to a fuel oil pool. An embodiment of the present disclosure is one, any or all of prior embodiments in this paragraph up through the first embodiment in this paragraph further comprising at least one of sensing at least one parameter of the integrated process for maximizing recovery of hydrogen and generating a signal or data from the sensing; generating and transmitting a signal; or generating and transmitting data.

A second embodiment of the present disclosure is a process for hydrotreating a hydrocarbon residue stream comprising adding a first hydrogen stream to the hydrocarbon residue stream; hydrotreating the hydrocarbon residue stream over a demetallation catalyst to demetallize the hydrocarbon residue stream in the presence of the first hydrogen stream to provide a demetallized hydrocarbon residue stream reduced in metals and sulfur concentration; separating the demetallized hydrocarbon residue stream in a first stage hot separator to provide a first stage vapor stream comprising hydrogen and a first stage liquid stream; splitting the first stage liquid stream into a first liquid stream and a second liquid stream comprising low sulfur fuel oil; recovering the second liquid stream as a low sulfur fuel oil product stream; hydrotreating the first liquid stream over a desulfurization catalyst in the presence of a second hydrogen stream to provide a desulfurized hydrocarbon residue stream; separating the desulfurized hydrocarbon residue stream in a second stage hot separator to provide a second stage vapor stream and a second stage liquid stream; and mixing at least a portion of the second stage liquid stream with the low sulfur fuel oil product stream. An embodiment of the present disclosure is one, any or all of prior embodiments in this paragraph up through the second embodiment in this paragraph, wherein recovering the second liquid stream as a low sulfur fuel oil product stream comprises separating the second liquid stream to provide a flash overhead stream and the low sulfur fuel oil product stream. An embodiment of the present disclosure is one, any or all of prior embodiments in this paragraph up through the second embodiment in this paragraph, wherein the low sulfur fuel oil product stream comprises from about 0.3 wt % to about 1.5 wt % sulfur. An embodiment of the present disclosure is one, any or all of prior embodiments in this paragraph up through the second embodiment in this paragraph further comprising separating the second stage liquid stream to provide a flash vapor stream and a flash liquid stream; splitting the flash liquid stream into a first flash liquid stream and a second flash liquid stream; and mixing the first flash liquid stream with the second liquid stream to produce the low sulfur fuel oil product stream comprising from about 0.05 wt % to about 0.5 wt % sulfur.

A third embodiment of the present disclosure is a process for hydrotreating a hydrocarbon residue stream comprising adding a first hydrogen stream to a hydrocarbon residue stream; hydrotreating the hydrocarbon residue stream over a demetallation catalyst to demetallize the hydrocarbon residue stream in the presence of the first hydrogen stream to provide a demetallized hydrocarbon residue stream reduced in metals and sulfur concentration; separating the demetallized hydrocarbon residue stream in a first stage hot separator to provide a first stage vapor stream comprising hydrogen and a first stage liquid stream; splitting the first stage liquid stream into a first liquid stream and a second liquid stream comprising low sulfur fuel oil; recovering the second liquid stream as a low sulfur fuel oil product stream comprising from about 0.3 wt % to about 1.5 wt % sulfur; and hydrotreating the liquid stream over a desulfurization catalyst in the presence of a second hydrogen stream to provide a desulfurized hydrocarbon residue stream. An embodiment of the present disclosure is one, any or all of prior embodiments in this paragraph up through the third embodiment in this paragraph further comprising separating the desulfurized hydrocarbon residue stream in a second stage hot separator to provide a second stage vapor stream and a second stage liquid stream; and mixing at least a portion of the second stage liquid stream with the second liquid stream to produce the low sulfur fuel oil product stream comprising from about 0.05 wt % to about 0.5 wt % sulfur.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the present disclosure and to adapt it to various usages and conditions. The preceding preferred specific embodiments are, therefore, to be construed as merely illustrative, and not limiting the remainder of the present disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for hydrotreating a hydrocarbon residue stream comprising:

a) hydrotreating the hydrocarbon residue stream over a demetallation catalyst to demetallize the hydrocarbon residue stream in the presence of a first hydrogen stream to provide a demetallized hydrocarbon residue stream reduced in metals and sulfur concentration;

b) separating the demetallized hydrocarbon residue stream in a hot separator to provide an overhead vapor stream comprising hydrogen and a bottoms liquid stream;

c) splitting the bottoms liquid stream into a first liquid stream and a second liquid stream comprising low sulfur fuel oil;

d) recovering the second liquid stream as a low sulfur fuel oil product stream; and e) hydrotreating the first liquid stream over a desulfurization catalyst in the presence of a second hydrogen stream to provide a desulfurized hydrocarbon residue stream.

2. The process of claim 1, wherein recovering the second liquid stream as a low sulfur fuel oil product stream comprises separating the second liquid stream to provide a flash overhead stream and the low sulfur fuel oil product stream.

3. The process of claim 1, wherein the low sulfur fuel oil product stream comprises sulfur in an amount from about 0.3 wt % to about 1.5 wt %.

4. The process of claim 1 further comprising separating the desulfurized hydrocarbon residue stream to provide a vapor stream and a liquid stream.

5. The process of claim 4 further comprising separating the liquid stream to provide a hot flash vapor stream and a hot flash liquid stream.

6. The process of claim 5 further comprising:

splitting the hot flash liquid stream into a first flash liquid stream and a second flash liquid stream; and mixing the first flash liquid stream with the second liquid stream to produce the low sulfur fuel oil product stream comprising from about 0.05 wt % to about 0.5 wt % sulfur.

7. The process of claim 4 further comprising separating the vapor stream in a second cold separator to provide a second cold vapor stream and a second cold liquid stream and taking the first hydrogen stream from the second cold vapor stream.

8. The process of claim 7, wherein an entirety of the second cold vapor stream is taken as the first hydrogen stream.

9. The process of claim 1 further comprising separating the overhead vapor stream in a first cold separator to provide a first cold vapor stream and a first cold liquid stream.

10. The process of claim 9 further comprising separating the first cold vapor stream into a purge stream and a recycle stream; and taking the recycle stream as the second hydrogen stream.

11. The process of claim 9 further comprising separating the first cold liquid stream and the second cold liquid stream to provide a fuel gas stream and a cold flash liquid stream and subjecting the cold flash liquid stream to fluid catalytic cracking.

12. The process of claim 11 further comprising:

fractionating the cold flash liquid stream in a fractionation column to provide a bottoms stream; and mixing the bottoms stream with the low sulfur fuel oil product stream.

13. The process of claim 1 further comprising adding the second liquid stream to a fuel oil pool.

14. The process of claim 1 further comprising at least one of:

sensing at least one parameter of the process for maximizing recovery of hydrogen and generating a signal or data from the sensing;

generating and transmitting the signal; or generating and transmitting the data.

15. A process for hydrotreating a hydrocarbon residue stream comprising:

a) adding a first hydrogen stream to the hydrocarbon residue stream;

b) hydrotreating the hydrocarbon residue stream over a demetallation catalyst to demetallize the hydrocarbon residue stream in the presence of the first hydrogen stream to provide a demetallized hydrocarbon residue stream reduced in metals and sulfur concentration;

c) separating said demetallized hydrocarbon residue stream in a first stage hot separator to provide a first stage vapor stream comprising hydrogen and a first stage liquid stream;

d) splitting the first stage liquid stream into a first liquid stream and a second liquid stream comprising low sulfur fuel oil;

e) recovering the second liquid stream as a low sulfur fuel oil product stream;

f) hydrotreating the first liquid stream over a desulfurization catalyst in the presence of a second hydrogen stream to provide a desulfurized hydrocarbon residue stream;

g) separating the desulfurized hydrocarbon residue stream in a second stage hot separator to provide a second stage vapor stream and a second stage liquid stream; and h) mixing at least a portion of the second stage liquid stream with the low sulfur fuel oil product stream.

16. The process of claim 15, wherein recovering the second liquid stream as a low sulfur fuel oil product stream comprises separating the second liquid stream to provide a flash overhead stream and the low sulfur fuel oil product stream.

17. The process of claim 15, wherein the low sulfur fuel oil product stream comprises from about 0.3 wt % to about 1.5 wt % sulfur.

18. The process of claim 15 further comprising:

separating the second stage liquid stream to provide a flash vapor stream and a flash liquid stream;

splitting the flash liquid stream into a first flash liquid stream and a second flash liquid stream; and mixing the first flash liquid stream with the second liquid stream to produce the low sulfur fuel oil product stream comprising from about 0.05 wt % to about 0.5 wt % sulfur.

19. A process for hydrotreating a hydrocarbon residue stream comprising:

a) adding a first hydrogen stream to a hydrocarbon residue stream;

b) hydrotreating the hydrocarbon residue stream over a demetallation catalyst to demetallize the hydrocarbon residue stream in the presence of the first hydrogen stream to provide a demetallized hydrocarbon residue stream reduced in metals and sulfur concentration;

c) separating said demetallized hydrocarbon residue stream in a first stage hot separator to provide a first stage vapor stream comprising hydrogen and a first stage liquid stream;

d) splitting the first stage liquid stream into a first liquid stream and a second liquid stream comprising low sulfur fuel oil;

e) recovering the second liquid stream as a low sulfur fuel oil product stream comprising from about 0.3 wt % to about 1.5 wt % sulfur; and f) hydrotreating the liquid stream over a desulfurization catalyst in the presence of a second hydrogen stream to provide a desulfurized hydrocarbon residue stream.

20. The process of claim 19 further comprising:

separating the desulfurized hydrocarbon residue stream in a second stage hot separator to provide a second stage vapor stream and a second stage liquid stream; and mixing at least a portion of the second stage liquid stream with the second liquid stream to produce the low sulfur fuel oil product stream comprising from about 0.05 wt % to about 0.5 wt % sulfur.

* * * * *